US011821318B2

(12) United States Patent
Bahnev

(10) Patent No.: US 11,821,318 B2
(45) Date of Patent: Nov. 21, 2023

(54) CAM MACHINE WITH ADJUSTMENT MECHANISM

(71) Applicant: Boyan Kirilov Bahnev, Plovdiv (BG)

(72) Inventor: Boyan Kirilov Bahnev, Plovdiv (BG)

( * ) Notice: Subject to any disclaimer, the term of this patent is extended or adjusted under 35 U.S.C. 154(b) by 18 days.

(21) Appl. No.: 17/627,449

(22) PCT Filed: Jul. 23, 2020

(86) PCT No.: PCT/BG2020/000030

§ 371 (c)(1),
(2) Date: Jan. 14, 2022

(87) PCT Pub. No.: WO2021/016677

PCT Pub. Date: Feb. 4, 2021

(65) Prior Publication Data

US 2022/0170370 A1 Jun. 2, 2022

(30) Foreign Application Priority Data

Jul. 26, 2019 (BG) ..... 112972

(51) Int. Cl.

| | |
|---|---|
| ***F01B 3/04*** | (2006.01) |
| ***F02B 75/28*** | (2006.01) |
| ***F01B 3/00*** | (2006.01) |
| ***F01B 9/06*** | (2006.01) |

(52) U.S. Cl.

CPC ..... *F01B 3/04* (2013.01); *F01B 3/0002* (2013.01); *F01B 9/06* (2013.01); *F02B 75/28* (2013.01)

(58) Field of Classification Search

CPC .. F01B 3/04; F01B 3/0002; F01B 9/06; F01B 3/045; F01B 2009/061; F01B 2009/063; F01B 2009/065; F01B 2009/066; F01B 2009/068; F02B 75/28; F02B 75/282

See application file for complete search history.

(56) References Cited

U.S. PATENT DOCUMENTS

2014/0150643 A1* 6/2014 Bahnev ..... F01B 9/06 92/12.1

* cited by examiner

*Primary Examiner* — Jacob M Amick
(74) *Attorney, Agent, or Firm* — AVEK IP, LLC

(57) ABSTRACT

The invention relates to a cam machine with a control mechanism which will find application in various fields of mechanical engineering, such as compressor machines, hydraulic pumps, internal combustion engines and other types of engines in various land, sea and air vehicles, or in stationary units.

The created cam machine improves the contact between the cam profiles (15*a*, 15*b*) of the cam bushings (16*a*, 16*b*) and the followers (1*a*, 1*b*). The main improvement of the machine is in the design of the regulating mechanism, which increases the reliability and the service life of the cam machine. In addition, simple and reliable control mechanisms are integrated in the machine, which at the same time simplifies the process of adjusting the cam machines.

27 Claims, 13 Drawing Sheets

Fig. 2a

CAM MACHINE WITH ADJUSTMENT MECHANISM

FIELD OF THE INVENTION

The invention relates to a cam machine with an adjusting mechanism, which will find application in various fields of mechanical engineering, such as compressor machines, internal combustion engines and other types of engines used in various land, sea and air vehicles or in stationary units.

BACKGROUND OF THE INVENTION

The cam mechanisms are a means of transforming movements with high precision and simplicity. The cam mechanisms have limited applicability, mainly due to their mechanical wear. It is caused due to friction between the followers and the cam and due to periodic interruptions of the contact between the followers and the cam profile and subsequent shock restoration of the contact.

Cam mechanisms and machines are known in which the causes of the intensive wear of the cam mechanisms, which are disclosed in international applications PCT/BG2006/000017 (D1) and PCT/BG2012/000018 (D2), are partially eliminated. These cam mechanisms consist of two asynchronously moving pistons whose axes coincide with the axis of a 3D composite tubular cam. The cam is mounted on bearing in the machine body and a corrugated groove is located on its inner cylindrical surface. The connections between the pistons and the cam are made by two V-shaped followers, which are in contact with the cam profiles of the channel by means of main bearing rollers. The main bearing rollers reduce friction and wear of the cam profile, respectively. The guidance of each V-shaped follower is carried out with columns that are parallel to the axis of the 3D composite cam and are connected to followers and to the body of the piston machine. The connection between the columns and the followers is fixed, and between the body and the columns axially—movable. A solution is indicated in which the type of these connections is exchanged—the connection between the columns and the followers is axially movable, and between the machine body and the columns fixed. In some of the constructive solutions a cam profile is presented, the cross section of which is concave and the roller has a convex cross section. With such contact, wear is further reduced. In addition, to increase the reliability of the contact between the cam and the followers, each follower is provided with additional rollers which contact the cam profile of the channel, which is opposite to the cam profile with which their respective main rollers contact. The auxiliary rollers are elastically connected to their respective follower so that each auxiliary roller can be moved in the direction of the axis of its respective main roller. This movement allows each additional roller to maintain both its own contact with its respective cam profile and the contact of its respective main roller, regardless of the location of the cam channel through which the additional roller passes. In D2, a variable width of the cam channel is proposed, which minimizes the additional rollers relative displacement in the direction of their respective Main rollers axes. This constructive solution helps to improve the uniformity of the cam mechanism movement. D2 also provides additional rotational movement of the additional rollers around the axes of their respective main rollers, which allows them to orient themselves to the cam profile on which they roll so that they can be rolled without sliding.

D2 also offers a mechanism for adjusting the cam machine. Through the specified adjusting mechanism, the additional rollers are brought into contact with their respective cam profiles and the contact between them is maintained during the operation of the cam machine.

According to the description in D2 and the figures attached to it, it is clear that the cam machine adjustment is done for each additional roller individually. In this case, each plunger carrying an additional roller is pressed against the respective cam profile by means of two position nuts. The first nut is screwed into the respective main bearing journal until the respective additional roller touches its adjacent cam profile and deforms its adjacent springs to a size that ensures continuous contact during the operation of the mechanism. The second nut is tightened to the first to secure it against self-unscrewing.

However, significant problems appear in the described construction of the cam mechanism in D2. One of the adjusting mechanism main problems in this case is the difficult access to the two position nuts, as the position nuts are located in the cylindrical cavities of the main bearing journals and the main bearing journals in turn are inside the compound cam.

Another adjusting mechanism imperfection of the cam machine in D2 is the two-way restriction that is imposed on each plunger when it is moved in the direction of the axis of its respective main bearing journal. In practice, this restriction is effected by bilateral contact between each pair of self-locking position nuts mentioned above and the adjacent plunger. On the one hand, the position nuts contact the adjacent plunger by means of an axial bearing, and on the other hand the position nuts are again in contact with the same plunger by means of another axial bearing. However, it turns out that this connection is sufficient to be one-way, because the movement of the plunger is limited in the direction of the cam profile by the cam profile itself. The two-way connection requires the use of more elements than necessary to build the mechanism for regulating the cam machine, which increases the weight of the followers and causes the appearance of greater inertial forces during operation of the cam machine. Increased inertial forces wear the cam profiles faster.

SUMMARY OF THE INVENTION

It is an object of the invention to improve the operation and reliability of cam machines by creating new, simple and reliable mechanisms for adjusting the kinematics of cam machines, as well as to facilitate access to the control mechanism and the way of adjusting the cam machines.

The problem is solved by creating a cam machine that contains a housing, at least one cylinder, at least one piston moving in the cylinder, a cylindrical tubular 3D cam. The cylindrical tubular 3D cam has a cam channel on the inner cylindrical surface, which channel is made so that the line forming its cross section is the concave line having two cam profiles and a bottom between them, which is laterally located relative to the axis of the 3D cam. The cam machine also includes at least two asynchronously moving followers located opposite each other, each follower comprising at least two arms connected respectively to one of the two pistons or to one piston and one balancing element. The anus at an angle to each other are provided with tubular main bearing journals with main rollers bearing at the free ends of the respective arms. Each follower also comprises a cylindrical plunger located in the main bearing journals, which cylindrical plungers comprise additional bearing journals bearing additional rollers. The additional rollers have the possibility to simultaneously move and rotate in the direction and around the axes of the respective main rollers so that each main and additional roller is in contact with its respective profile of the cam channel. According to the invention, the tubular main bearing journals have threaded holes in which screw regulators are mounted, contacting indirectly or directly with the plungers. The indirect contact between the plungers and the adjacent screw regulators is made through elastic and bearing elements, and the direct contact is also realized through pins, each of which is part of the respective screw regulator. The maximum clearances formed by the indirect contacts between the pins and the plungers are at least equal to the strokes of the rectilinear movements of the plungers at one complete rotation of the 3D cam. The connections between each plunger and the elements located in its respective bearing journal are one-sided so that the plungers can be freely removed from the adjacent bearing journals when the cam machine is disassembled.

A functional insert is installed in each plunger, in contact with the pin when realizing direct contact between the respective screw regulator and the plunger. The thickness of each functional insert can be adjusted by means of the thickness of a corresponding test insert, which is monolithic or composed of several elements. At least one element of the test insert is easily deformable, and the reference thickness of the test insert is obtained by squeezing it under the working influence of the cam machine.

In a preferred embodiment, each screw regulator consists of a tubular cylindrical body, on the outer and inner cylindrical surfaces of which an external and an internal thread are cut, respectively, wherein an adjustable pin and a fixing element are wound in the internal thread, the gap between each adjustable pin and its adjacent plunger is at least equal to the axial stroke of the plunger at a complete rotation of the 3D composite cam.

The formation of the cam channel of the 3D cam is carried out by two cam bushings, each having a wavy cam profile on one side, the cam bushes being coaxial and spaced from each other with their corrugated ends facing each other so that the convex parts of the cam profile of one of the bushings are opposite to the recesses of the cam profile of the other bushing. The 3D cam performs a rotational motion and is mounted on a bearing in the body of the cam machine.

The cam machine contains at least two more guide columns for reciprocating linear motion of each follower, which columns are parallel and equidistant from the axis of the 3D cam. The columns are connected to followers and to the body of the cam machine. The connection between the columns and the followers is fixed, and between the housing and the columns axially—movable. Mother solution is applicable in which the connection between the columns and the followers is axial—movable, and between the machine body and the columns fixed.

The cam groove is made so that in the upper and lower dead centres, the distance between the channel cam profiles of the 3D composite cam in the cross section is the largest. The cross-sectional distance between the cam profiles of the 3D composite cam channel between any two adjacent dead centres is the smallest so that the displacement of the additional bearing rollers along the axes of the main bearing rollers is minimized.

In one embodiment of the invention, the cam groove is designed in such a way that narrow grooves are formed along the rolling lines of the additional bearing rollers, having the greatest depth in the upper and lower dead centres and their depths between any two adjacent dead centres are minimal, so that the movement of the additional bearing rollers along the axes of the main bearing rollers is minimized.

In an alternative embodiment of the invention, the cam channel is designed so that along the additional bearing rollers rolling lines there are narrow convex tracks having the highest height between any two adjacent dead centres and their heights in the upper and lower dead centres are minimal, so that the movement of the additional bearing rollers along the axes of the main bearing rollers is minimized.

Each of the two cam bushings of the 3D composite cam is fixed and coaxially connected to a tubular element that is located between them.

In a preferred embodiment, the connection and orientation between the two cam bushings of the 3D composite cam is made by a tubular element which is a rotor of an electric machine and the transmission of torque between the cam bushings is carried out by means of teeth and sockets located on the cam bushings contact faces, and the stator of the electric machine is fixedly connected to the housing elements of the cam machine.

In another preferred embodiment, the connection and orientation between the two cam bushings of the composite 3D cam is made by two flanges, one flange on each of the bushings, which flanges are located around the sides of the corrugated cam profiles, the connection between the flanges being fixed and is secured by fasteners.

A gear ring is made on the periphery of the flanges for transmitting mechanical energy to an external working machine or for receiving energy from an external source of mechanical energy.

In another preferred embodiment of the invention, the connection and orientation between the two cam bushings of the 3D composite cam is made by at least two lugs located around the sides of each of the bushing having corrugated cam profiles, wherein the connection between the lugs of the opposite cam bushings is stationary and is secured by fasteners.

The created cam machine can work as a compressor or hydraulic pump, in which at least one cylinder head is included, hermetically closing the cylinder or one of the cylinders, performing a working cycle in it, in which the exchange of fluids accompanying the processes of filling and emptying the cylinder or the cylinders is realized by means of opening and closing the compressor chamber.

It is possible for the cam machine to be realized as a cam engine in which there is at least one cylinder head, hermetically closing the cylinder or one of the cylinders, performing a working cycle in it, where the fluid exchange accompanying the working cycles in the cylinder or cylinders is realized by at least one kinematic circuit consisting of a 2D cam which is fixedly connected to the nearest adjacent side of the 3D composite cam. The cam engine also includes a rocker capable of rotating about an axis under the influence of the 2D cam, at least one suction or discharge valve performing reciprocating motion under the action of the rocker and at least one return spring holding the intake or exhaust valve in the closed position.

An advantage of the created cam machine is the improved contact between the cam profile and the followers, thus ensuring reduced wear, which is a prerequisite for increasing the length of its service life. In addition, the machine has integrated control mechanisms with a simplified design, which in turn is a prerequisite for facilitating the process of adjusting the cam machine.

DESCRIPTION OF THE ATTACHED FIGURES

This invention is illustrated in the accompanying drawings, in which:

FIG. 1 is a sectional view of a double piston cam machine;

FIG. 2*a* is a general view of a cam adjustment mechanism unit;

FIG. 2*b* is a sectional view of the cam machine adjustment unit of FIG. 2*a;*

FIG. 2*c* is a view of indirect contact between a screw regulator and a plunger;

FIG. 2*d* is a view of a direct contact between a screw regulator and a plunger;

FIG. 3 is an axonometric view of a cam machine adjustment mechanism;

FIGS. 4*a*, 4*b* and 5 represent a package of test inserts before and after they are used to set up the cam machine and functional insert;

FIG. 6*a* is a sectional view of a screw regulator with an adjustable pin;

FIG. 6*b* is assembly diagram in axonometric view of a screw regulator with an adjustable pin;

FIG. 14 is a 3D composite cam with an orienting tubular element combined with an electric machine rotor;

EXAMPLES OF THE INVENTION

According to the invention, various double- or single-piston cam machines can be implemented, which perform different operating cycles depending on the user's need, and which cam machines can be compressors, pumps, internal combustion engines or combinations of the above.

Figure 1:
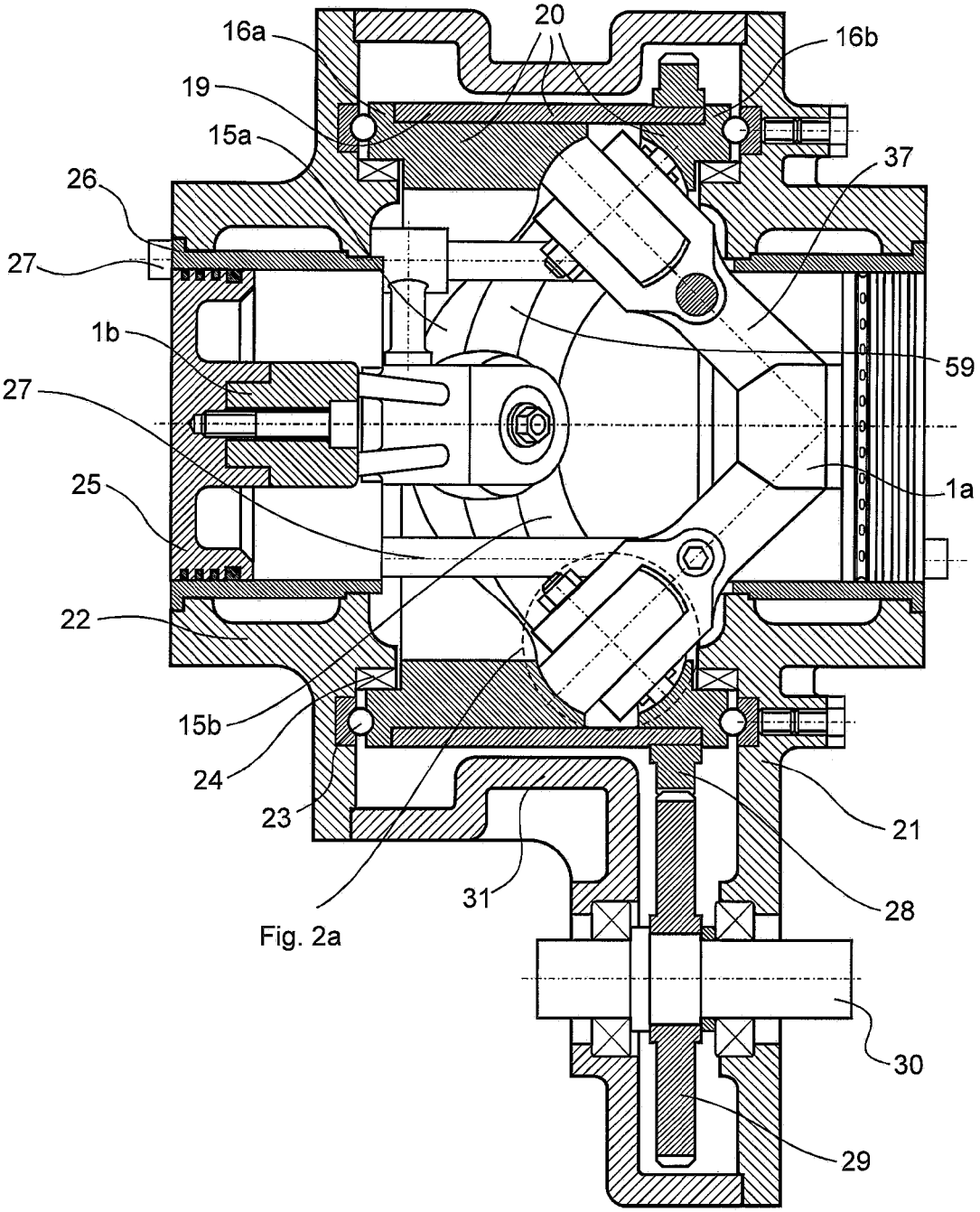

The created cam machine with adjusting mechanism shown in FIG. 1 includes a tubular 3D composite cam 20 which comprises cam bushings 16*a* and 16*b* and a tubular element 19 which orients the cam bushings 16*a* and 16*b* in such a way that their cam profiles 15*a*, 15*b* and the bottom 59, which is part of the tubular element 19, form a cam channel along the inner cylindrical surface of the 3D composite cam 20. The cam machine also comprises two identical followers 1*a* and 1*b*, each of which has two arms 37. Towards the free ends on the arms 37 main bearing journals 2 and main bearing rollers 3 are mounted. The main bearing journals 2 have a tubular geometry and in their cylindrical cavities additional bearing journals 4 are placed, on which additional bearing rollers 5 are mounted. The main bearing rollers 3 of the followers units 1*a* and 1*b* contact the cam profiles 15*a* and 15*b* of the cam bushings 16*a* and 16*b*, respectively. The 3D composite cam 20 is mounted on bearings bilaterally in cylinder blocks 21 and 22 by means of an axial 23 and a radial 24 bearing on each side. Each follower 1*a* and 1*b* is connected to a piston 25, which is located in a respective cylinder 26. The axes of the cylinders 26 coincide with the axis of the 3D composite cam 20. The axial guidance of the followers 1*a* and 1*b* is performed by guide columns 27, which are mounted on bearings in the cylinder blocks 21 and 22. The reciprocating motion of the followers 1*a* and 1*b* is transformed into a rotation of the 3D composite cam 20, which transmits the rotational motion to a gear 28, which is fixedly connected to the 3D composite cam 20. The gear 28 is engaged with another gear 29, which drives an output shaft 30. The shaft 30 is mounted on bearings in the cylinder block 21 and the crankcase 31 (engine casing).

The structural unit representing the cam machine adjusting mechanism is shown in FIGS. 2*a*, 2*b*, 2*c* and 3.

Figure 2A:
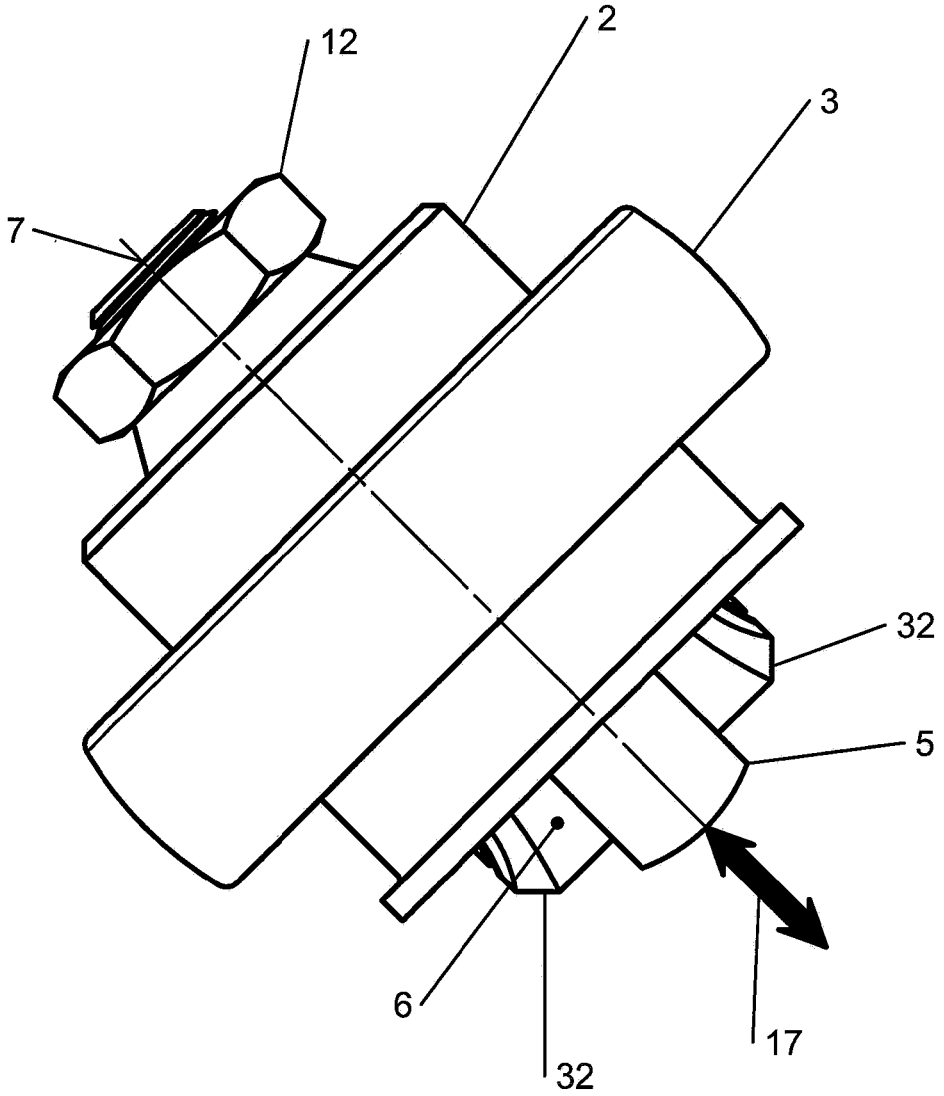
Figure 2B:
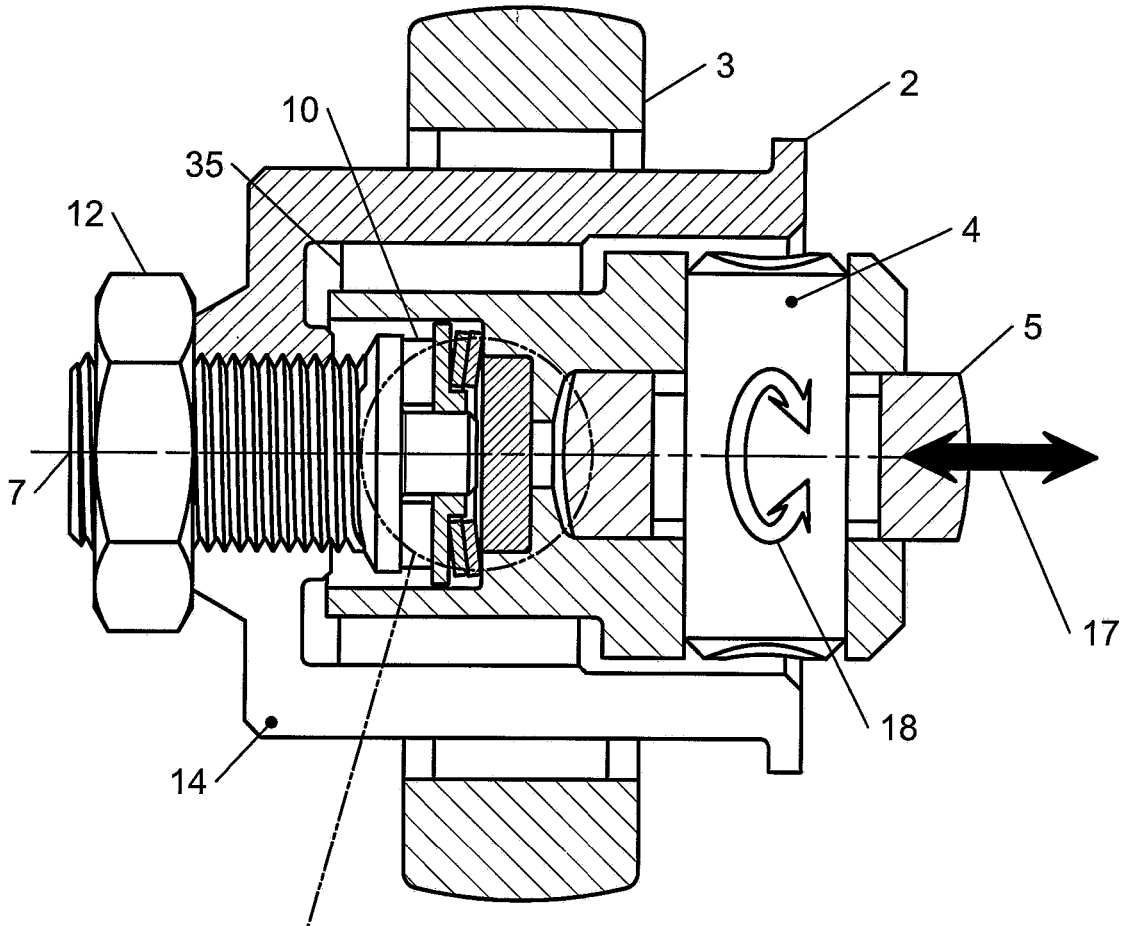
Figure 3:
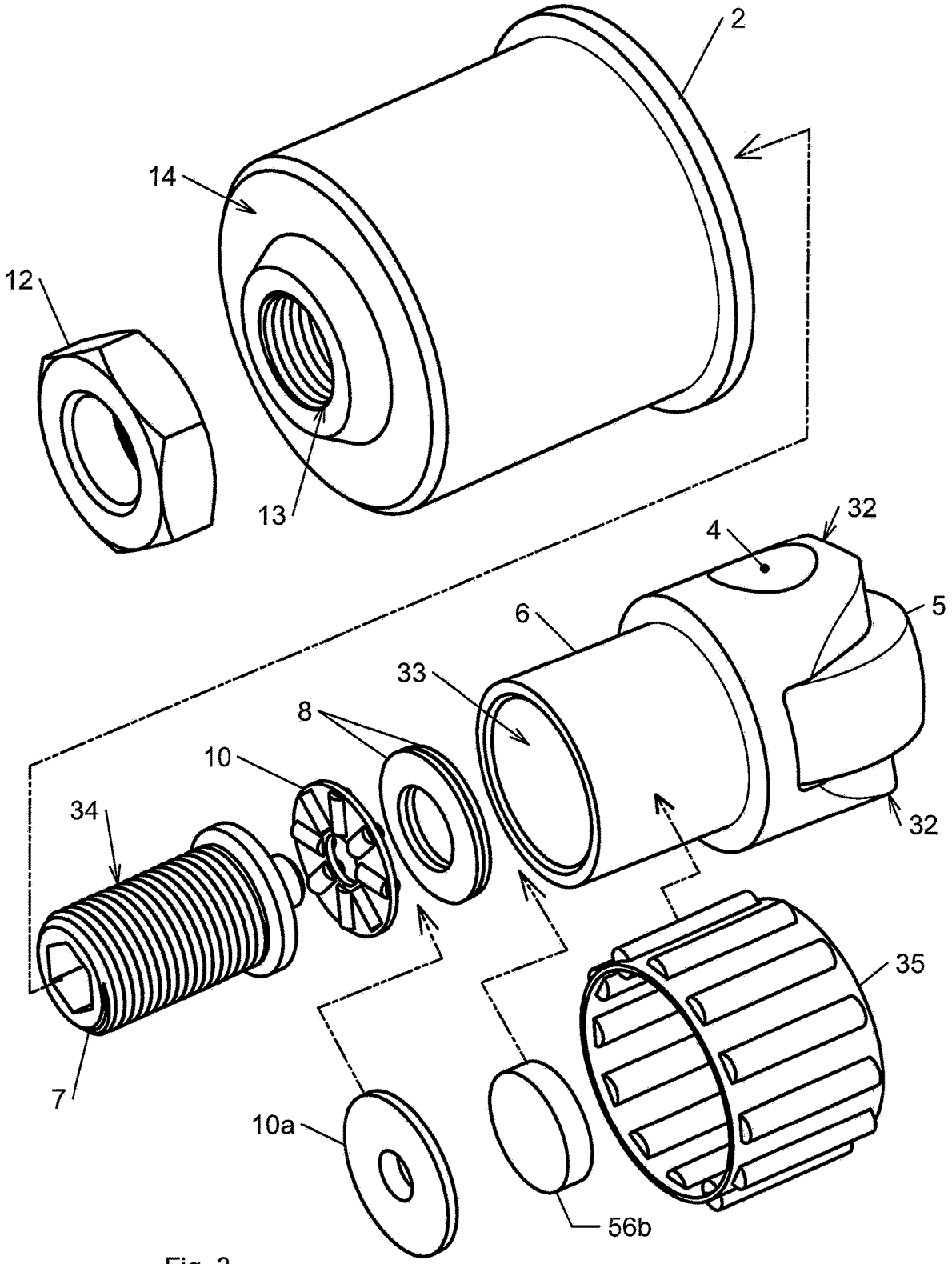

FIGS. 2*a*, 2*b* and FIG. 3 show that the additional bearing journals 4 are mounted in holes located in the lugs 32 of the cylindrical plungers 6. On the opposite side of the lugs 32, on each plunger 6, a cylindrical cavity 33 is made, visible in FIG. 3, which houses a package of disc springs 8 and an axial bearing 10, which are mounted on a pin 11 of a screw regulator 7. The screw regulator 7 has a threaded stem 34, through which it is screwed into a threaded hole 13 located in the bottom 14 on each main bearing journal 2. The threaded hole 13 and the bottom 14 are visible in FIG. 3. Through the nut 12 the screw regulator 7 is fixed when adjusting the cam mechanism. Each plunger 6 is mounted radially in the cylindrical cavity 33 of its respective main bearing journal 2 by means of a radial bearing 35 which does not restrict the displacement 17 of the plunger 6 in the direction of the axis of its adjacent main bearing journal 2. It is also seen from FIG. 2*b* that the plunger 6 can also perform a rotational movement 18 around the axis of the adjacent main bearing journal 2 simultaneously with the displacement 17 in the direction of the same axis. The displacement 17 provides a constant contact between each additional roller 5 land the corresponding cam profile 15*a* or 15*b*, and the rotation 18 allows self-orientation of the additional rollers 5 relative to their respective cam profile, based on the principle of least resistance, thus eliminating the additional rollers 5 slippage when rolling on the respective cam profile 15*a* or 15*b*.

Figure 2C:
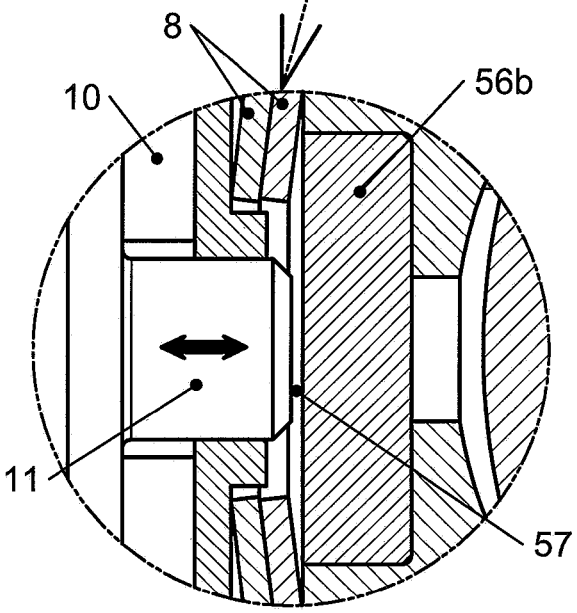
Figure 2D:
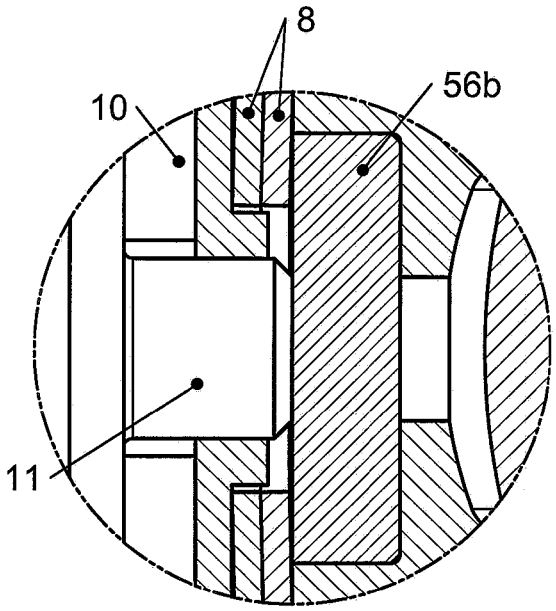

FIGS. 2*c* and 2*d* show that two types of contact are made between each screw regulator 7 and its respective plunger 6—indirect and direct. The indirect contact illustrated in FIG. 2*c* is realized through the disc spring package 8 and the axial bearing 10. The direct contact illustrated in FIG. 2*d* is made only in cases when the inertial forces from the reciprocating motion of the followers 1*a* and 1*b* are sufficiently large to overcome the resistance of the disc springs 8 and to move the plunger 6 until it touches the pin 11 of the screw regulator 7. The direct contact is made by functional insert 56*b*.

FIG. 3 is an assembly diagram of the cam machine control unit. It shows clearly that it is possible to remove the plunger 6 freely without any restrictions from the main bearing journal 2 in the direction from the screw regulator 7 to the additional roller 5. The movement of the plunger 6 is limited in this direction only by the cam profile 15*a* or 15*b* when the adjusting unit is mounted in the cam machine assembly.

Figure 4:
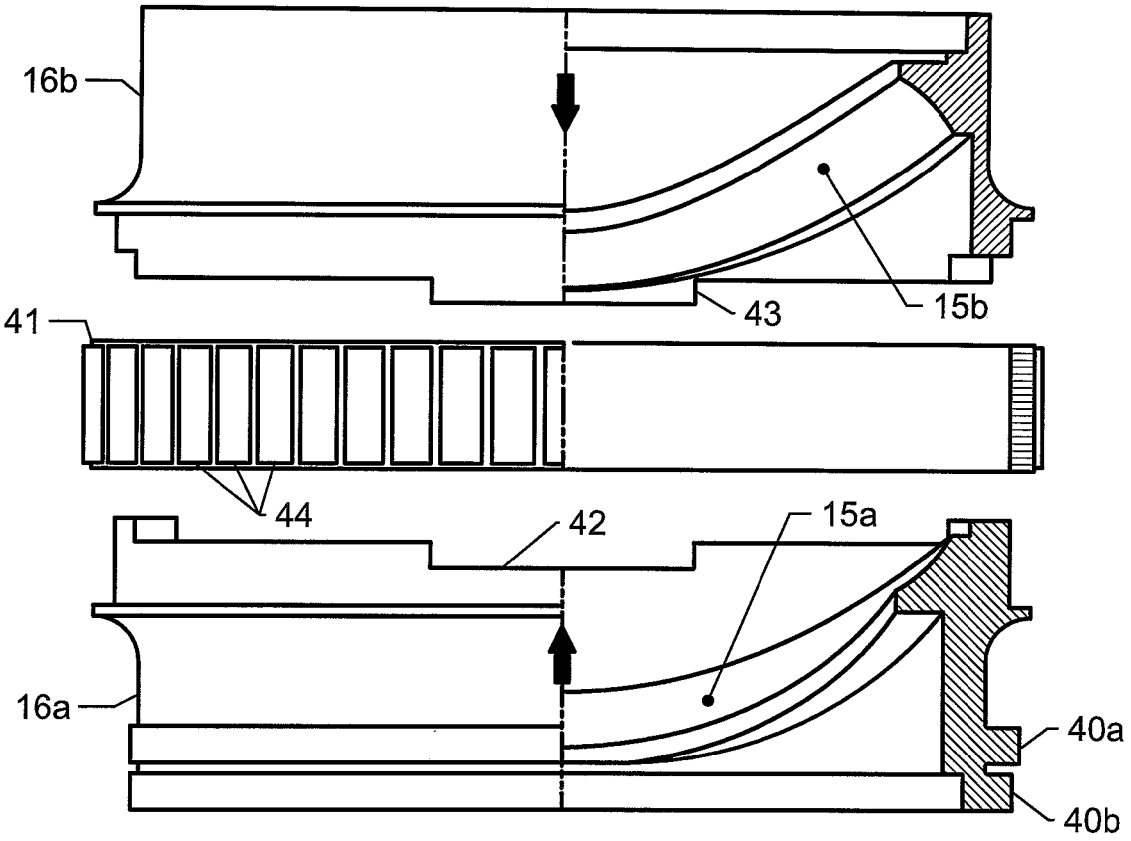
Figures 4A, 4B, 5:
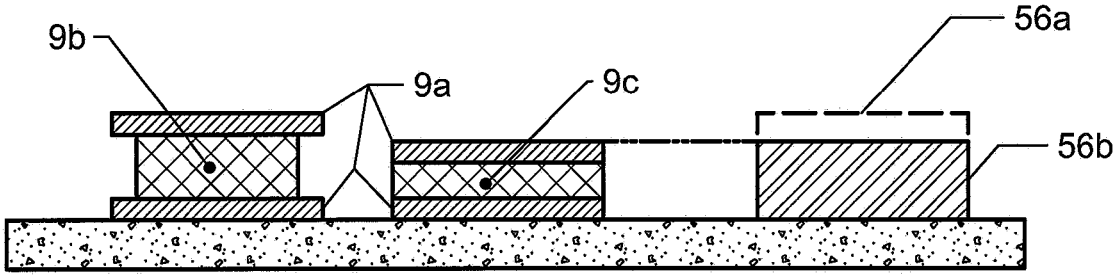

FIG. 4*a* shows a package of test inserts 9*a*, 9*b* and 9*a* before adjusting the cam machine, and FIG. 4*b* the same package after. The deformation of the package of test inserts, 9*a*, 9*c* and 9*a*, reflects the influence of the production tolerances on the displacement 17. The insert 9*b*/9*c* is easily deformable, where the easily deformable insert is marked 9*b* before being crushed and 9*c* thereafter. FIG. 5 compares the height of the transformed composite test insert with the height of the functional insert 56*b*.

Figures 6A, 6B:
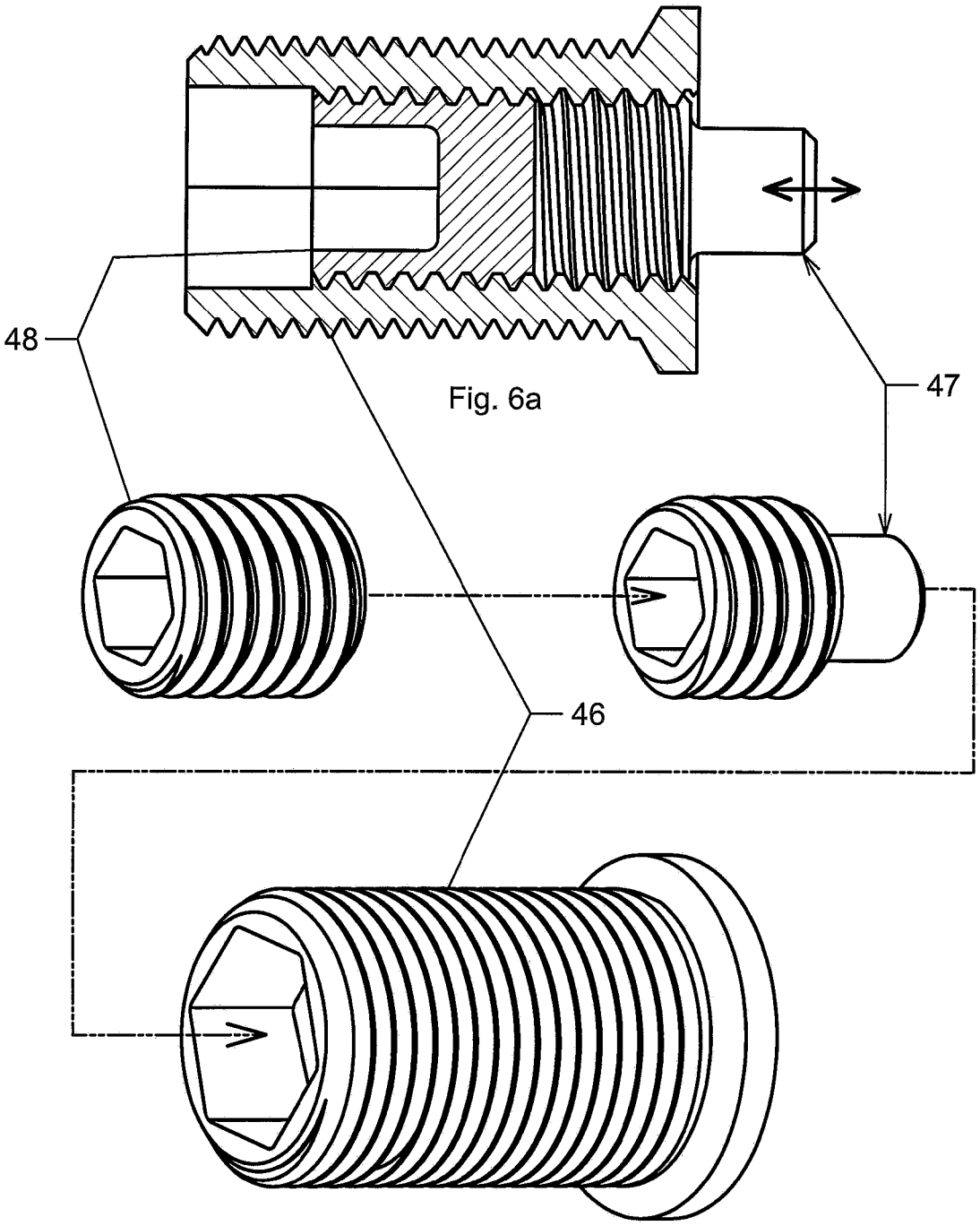

FIGS. 6*a* and 6*b* show a screw regulator 7 consisting of three parts: a body 46, an adjustable pin 47 and a fixing screw 48. Through the composite screw regulator 7 it is possible to achieve a more precise adjustment of the cam mechanism, both with the use of inserts and without them.

Figure 7:
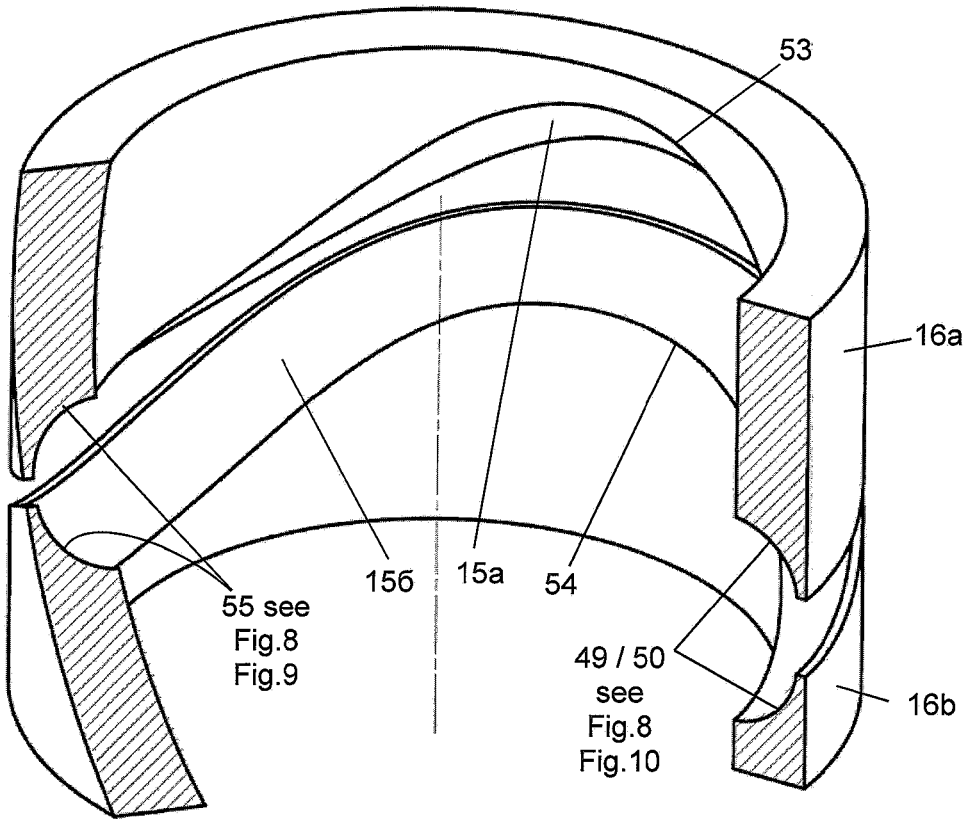
FIG. 7 is a sectional view of cam bushings in working position.
Figure 8:
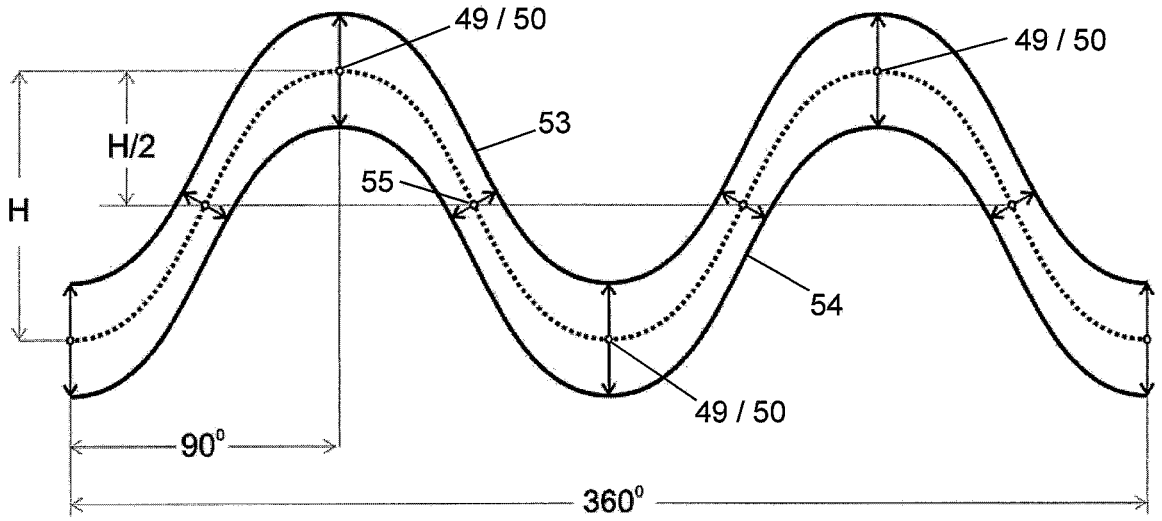
FIG. 8 is an unfolded view of the outer edges of a variable width cam channel.
Figure 9:
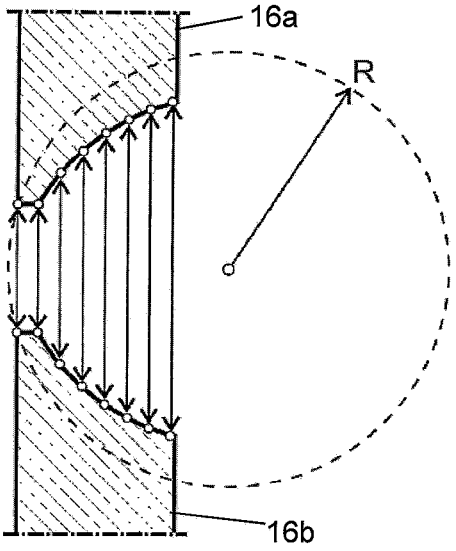
FIG. 9 is a cross-section of a cam channel between adjacent dead positions of the pistons at a variable width cam channel.

FIGS. 7, 8, 9 and 10 illustrate one way to minimize the relative displacement 17 of the additional rollers 5 in the direction of the axes of the main rollers 3. For this purpose, FIG. 7 shows two cross sections of the cam profiles 15*a* and 15*b* of the cams bushings 16*a* and 16*b* of the 3D composite cam 20. One of the sections shown in FIG. 10 also passes through the dead position 49/50 of the pistons 25, and the other, as shown in FIG. 9, through an intermediate position 55 which is located between two adjacent dead positions 49/50. Comparing the cross-sectional contour of FIG. 9 and the cross-sectional contour of FIG. 10, it is seen that the width of the cam channel of the 3D composite cam 20 shrinks at intermediate positions 55 and widens at dead positions 49/50. FIG. 8 shows that the transitions from narrowing to widening of the cam canal and vice versa take place gradually, where 53 and 54 are edges of the cam profiles 15*a* and 15*b*.

Figure 11:
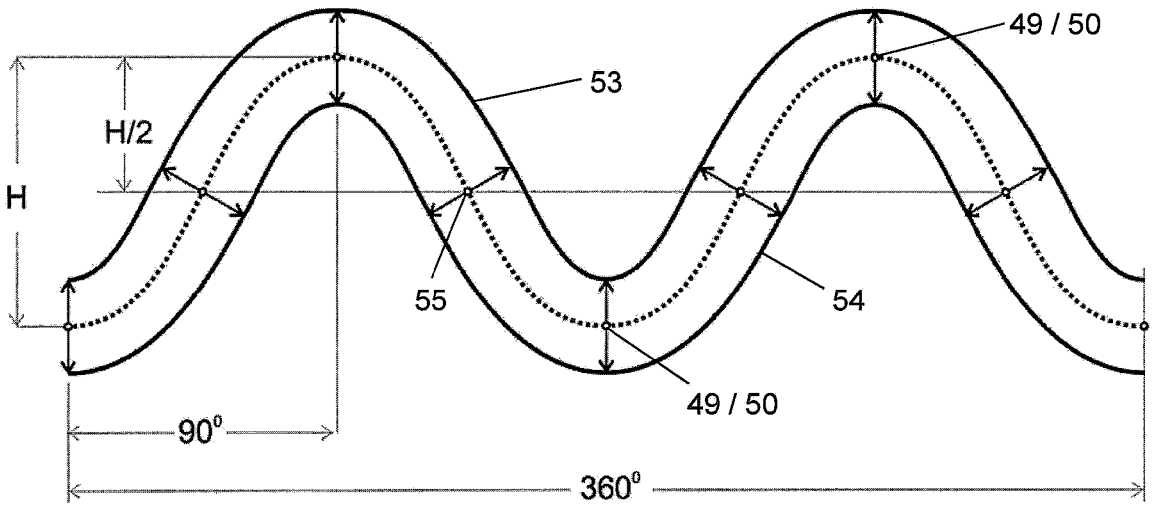
FIG. 11 is an unfolded view of the outer edges of a constant width cam channel.
Figure 12:
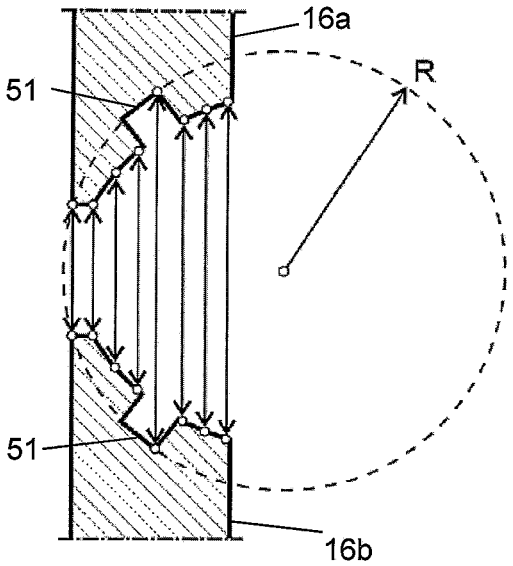
FIG. 12 is a cross-sectional view of a cam groove through the dead position of a piston in narrow grooves cam profiles.
Figure 13:
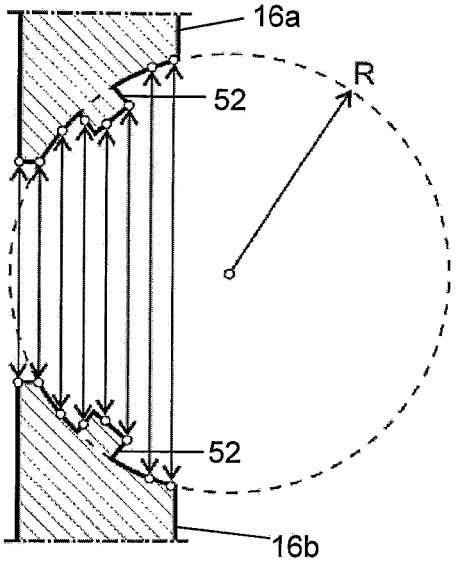
FIG. 13 is a cross-sectional view of a cam channel between adjacent dead positions of the pistons in track cam profiles.

FIGS. 11, 12 and 13 illustrate two additional ways to minimize the relative displacement 17 of the additional bearing rollers 5 in the direction of the axes of the main bearing rollers 3.

In the first alternative method shown in FIG. 12, on the cam profiles 15*a* and 15*b* of the cam bushings 16*a* and 16*b*, narrow grooves 51 are made for the additional bearing rollers 5. The depths of the grooves 51 are maximum in the dead positions 49/50 of the pistons 25 and the depths of the grooves 51 gradually reach their minimum in the intermediate positions 55 of FIG. 11. In cases where the minimum depths of the grooves 51 are equal to 0, then the cross sections in the intermediate positions 55 of FIG. 11 look as shown in FIG. 9.

Figure 10:
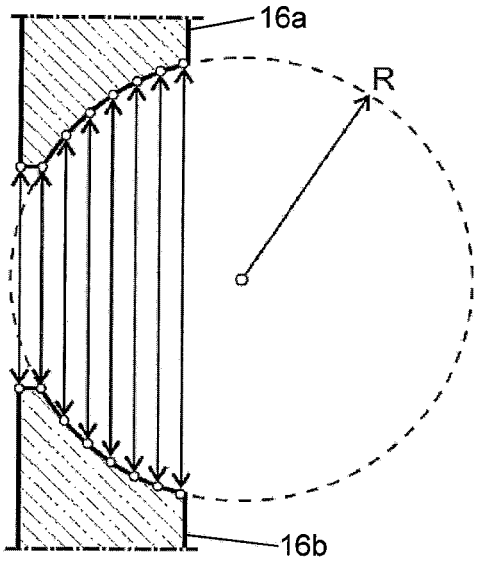
FIG. 10 is a cross-sectional view of a cam channel through the dead position of a piston at a variable width cam channel.

In the second alternative method shown in FIG. 13, on the cam profiles 15*a* and 15*b* of the cam bushings 16*a* and 16*b*, narrow tracks 52 are made for the additional bearing rollers 5. Their heights are maximum in the intermediate positions 55 of the pistons 25 in FIG. 11 and the heights of tracks 52 gradually reach their minimum in dead positions 49/50. In cases where the minimum heights of the tracks 52 are equal to 0, then the cross sections of the cam channel in the dead positions 49/50 in FIG. 11 look as shown in FIG. 10.

FIG. 14 shows an assembly diagram of the 3D composite cam 20. In this case, coaxial orientation between the cam bushings 16*a* and 16*b* is provided by a tubular element 41. The tubular element 41 is also a rotor of an electrical machine. Permanent magnets 44 are fixed to the outer cylindrical surface of the tubular element 41. Angular orientation and torque transmission between the cam bushings 16*a* and 16*b* is effected by teeth 43 and sockets 42. They are arranged on the contact front of the cam bushings 16*a* and 16*b*. FIG. 14 also shows 2D cams 40*a* and 40*b*, which drive the valves of a valve timing mechanism of an internal combustion engine.

Figure 15:
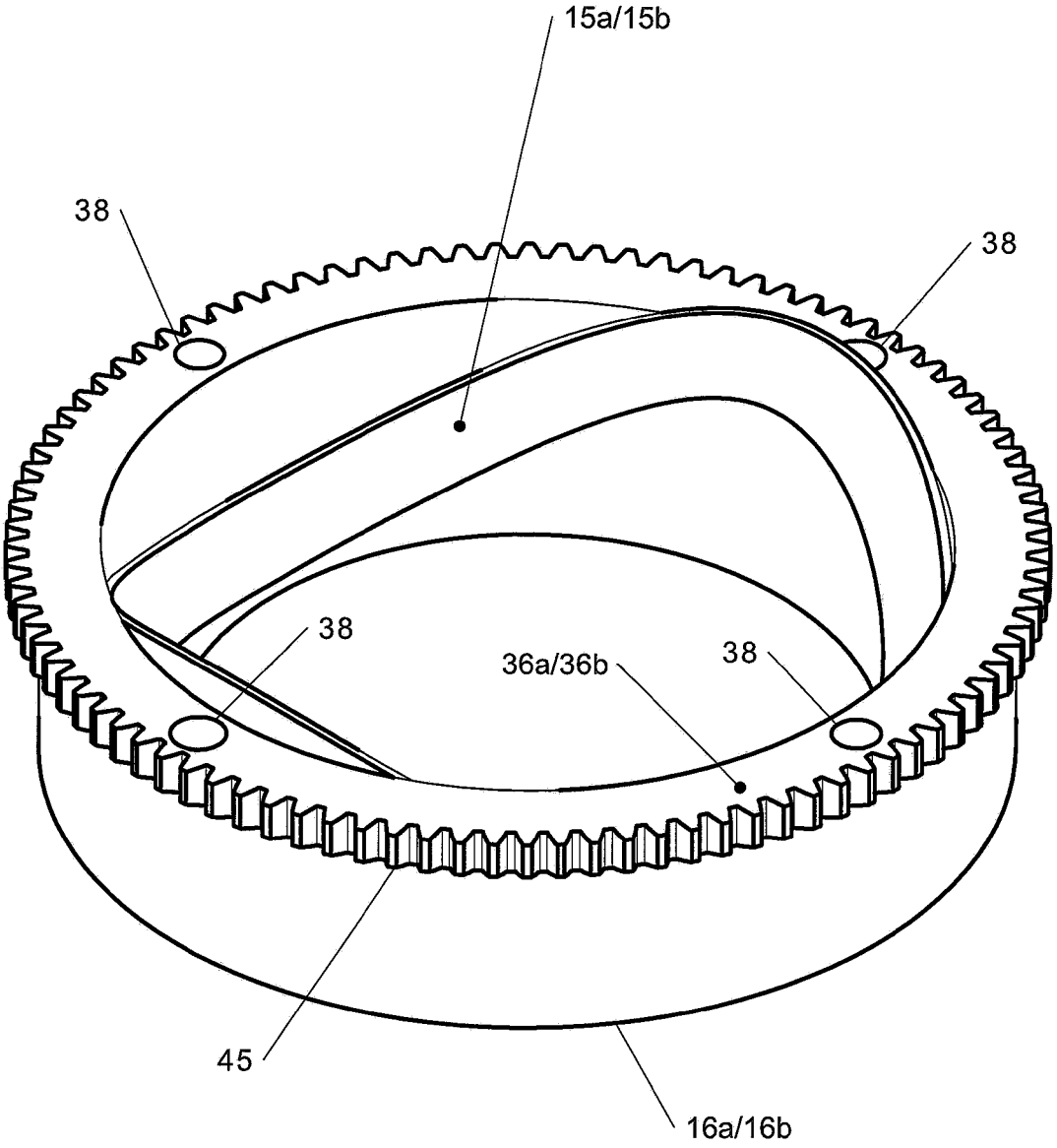
FIG. 15 shows a cam bushing with a flange for attachment to its opposite cam bushing and a gear ring made on the periphery of the flange.

FIG. 15 shows a cam bushing 16*a* or 16*b* having a flange 36 around the side of the cam bushing with a corrugated cam profile 15*a*/15*b*. The flange 36 is used to make a connection between the cam bushings 16*b* and 16*a*. Holes 38 for fastening and/or orientation elements are made on the front surface of the flange 36, which provide a fixed connection and orientation between the two cam bushings 16*a* and 16*b*. A gear ring 45 is made on the periphery of the flange 36, through which a rotational movement of the output or input shaft 30 is transmitted or received.

Figure 16:
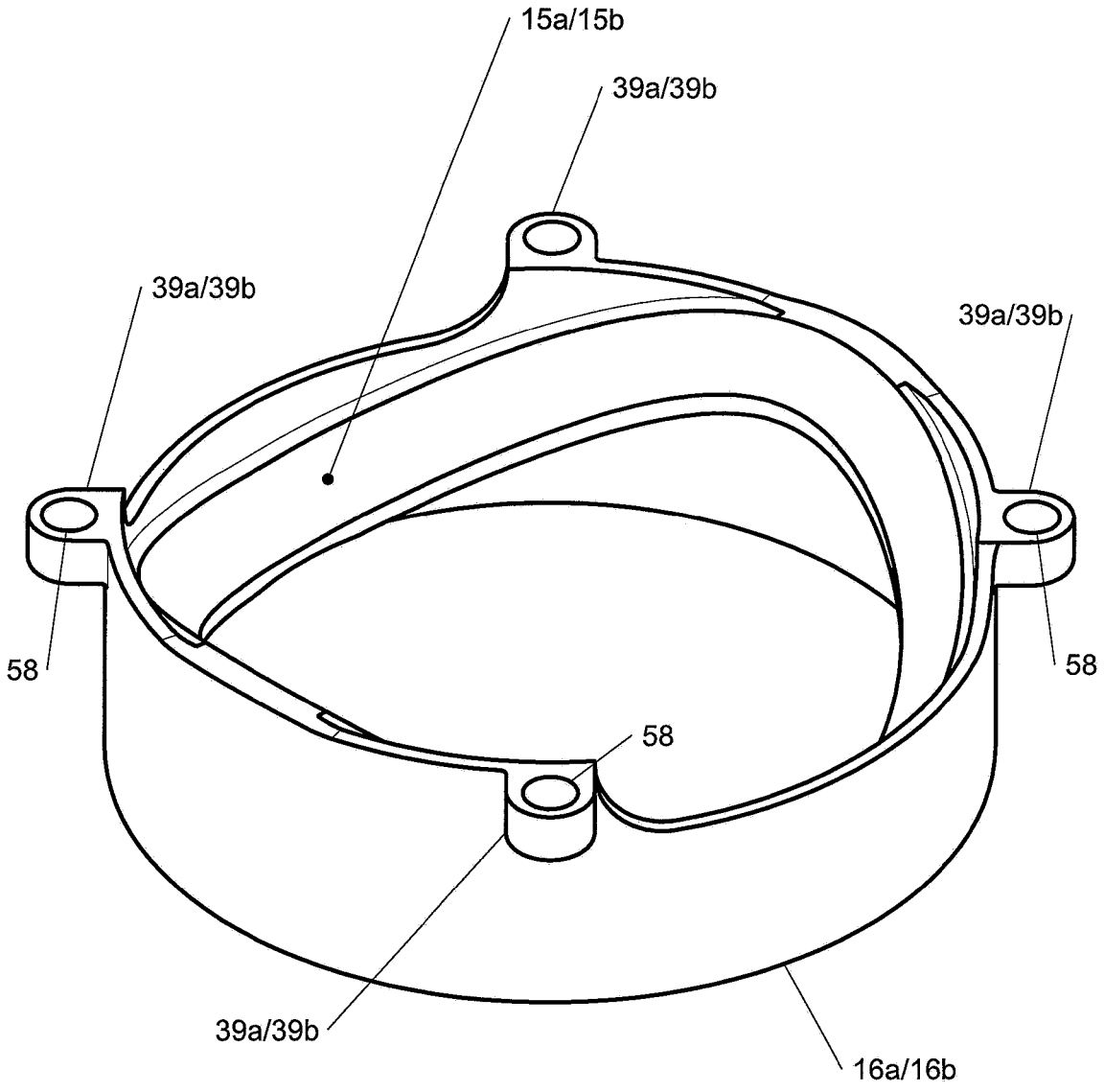
FIG. 16 is a cam bushing with lugs for attachment to its opposite cam bushing.

FIG. 16 shows a cam bushing 16*a* or 16*b*, which has lugs 39 for attachment to the opposite cam bushing 16*b* or 16*a*. Holes 58 are made in the lugs 39, which are used for elements, such as threaded connections and/or pins, which provide a fixed connection and angular orientation between the two cams 16*a* and 16*b*.

Figure 17:
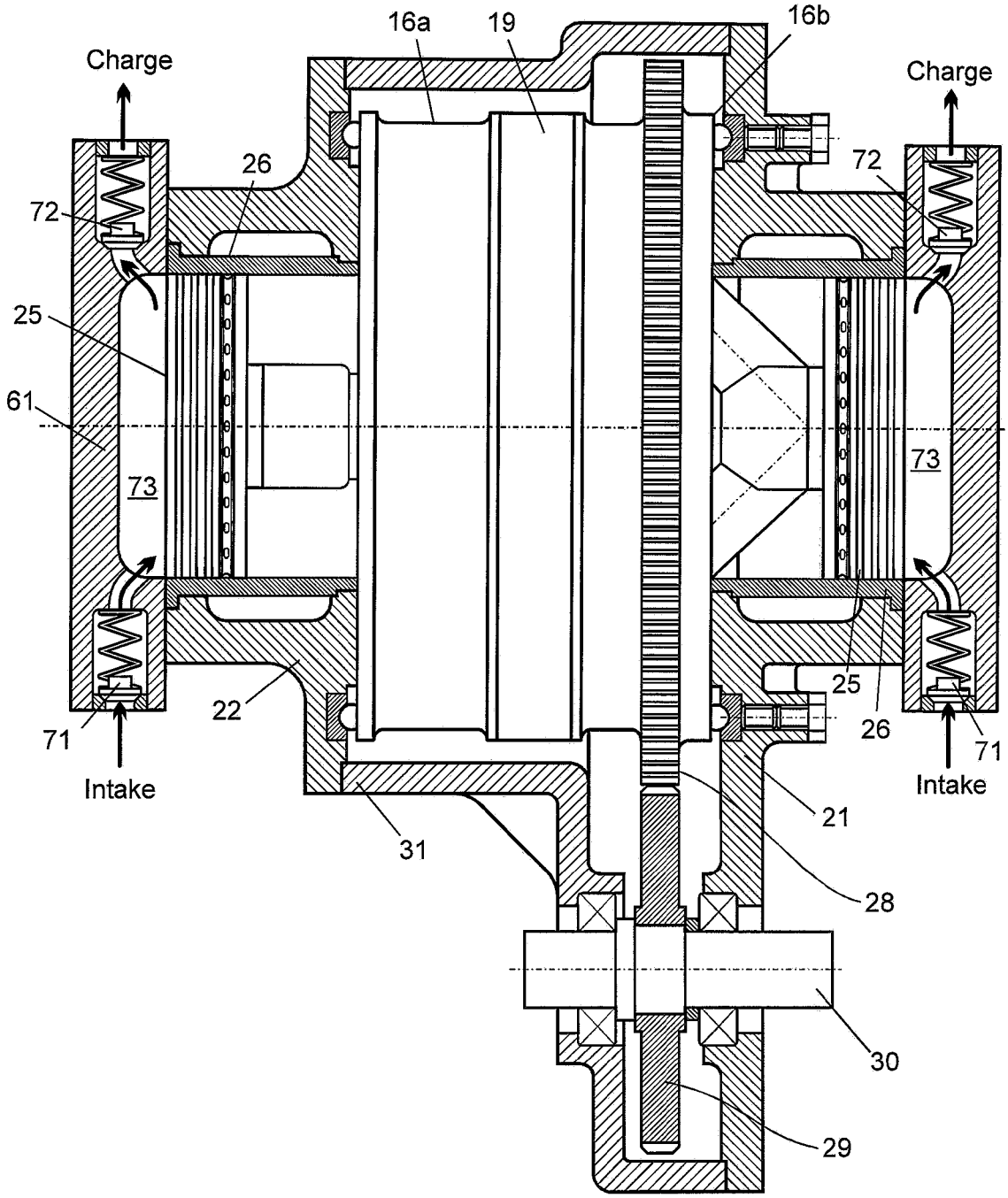
FIG. 17 is a sectional view of a two-cylinder cam machine realized as a compressor or hydraulic pump.

FIG. 17 shows a cam machine realized as a two-cylinder compressor. The compressor cylinders 26 are hermetically sealed with cylinder heads 61 in which compressor chambers 73 are made. Atmospheric air is supplied to each cylinder 26 by a low pressure check valve 71 and the compressed air is removed by another high pressure return valve. 72. When the pistons 25 move to a lower dead centre, a pressure is created lower than the atmospheric and the atmospheric air enters the cylinders 26. When the pistons move to a top dead centre, the air compresses in the cylinders 26 and the compressor chamber 73 and overcomes the spring force of the check valves 72. In this way the valves 72 open and the compressed air leaves the cylinders 26.

Figure 18:
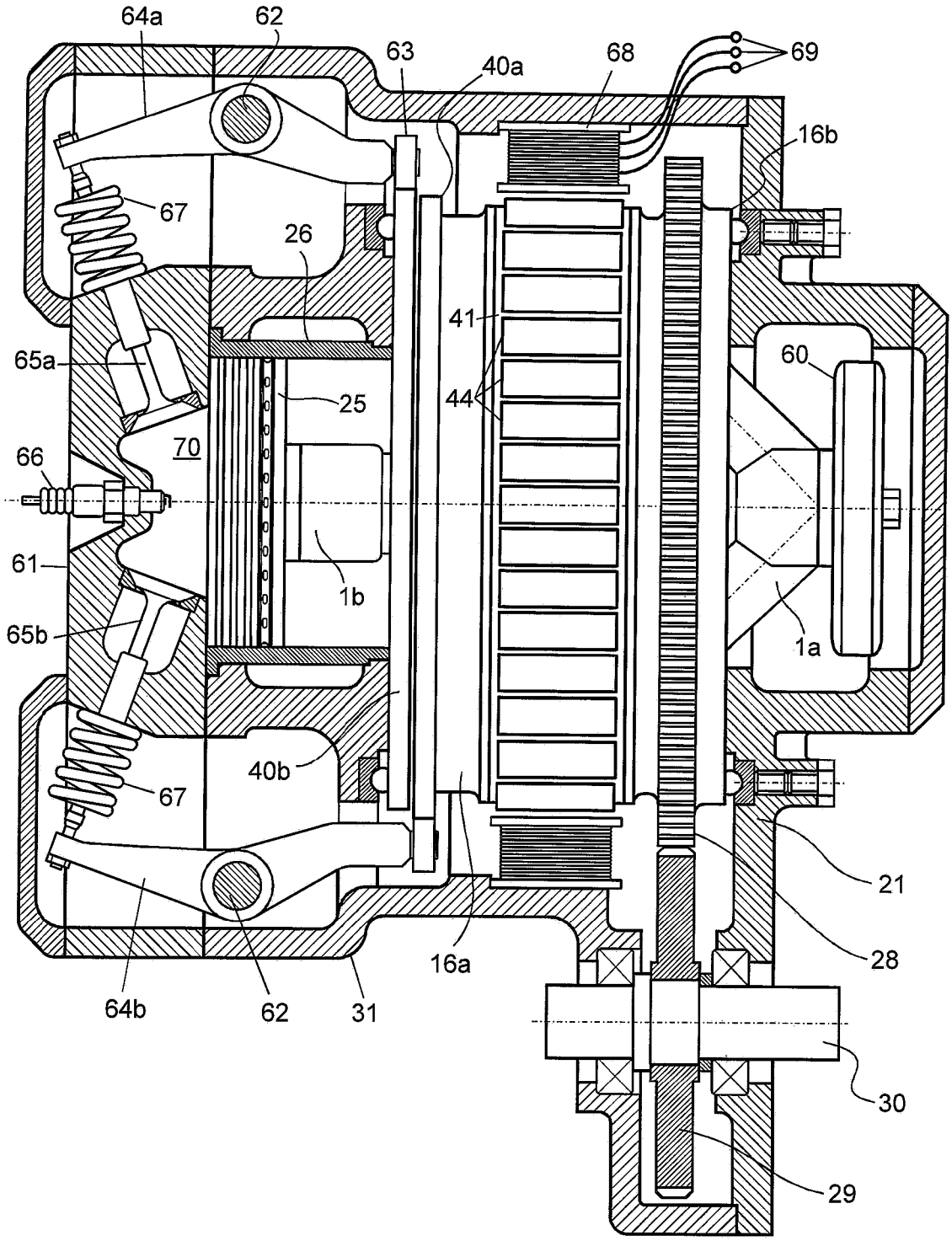
FIG. 18 is a sectional view of a cam machine realized as a single-cylinder internal combustion engine in combination with an electric generator.

FIG. 18 illustrates one of the many possible combinations between a cam machine, an electric machine, a compressor and a hydraulic pump. In this case, the cam machine is a single-cylinder spark-ignition internal combustion engine to which an electric machine is integrated. The follower 1*a* is connected to a balancing element 60 instead of a piston 25 in order to balance the inertial forces of the reciprocating motion of the two followers 1*a* and 1*b* together with all the elements carried by them. The only cylinder 26 is hermetically sealed with a cylinder head 61, as in the compressor shown in FIG. 17. The rotor 41 of the electric machine is made as shown in FIG. 14, and the stator 67 is fixedly connected to the housing element 31, which in this case is an integral part from the cylinder block 22. The generated output energy is obtained in the form of electricity dissipated through the wires 69 and mechanical torque transferred through the gears 28 and 29 and the output shaft 30. The valve timing mechanism of the engine shown consists of two kinematic circuits. One of them controls the access of fresh working substance in the cylinder 26, and the other controls the output of the spent working substance. Each of the kinematic circuits consists of a 2D cam 40*a* or 40*b*, which is fixedly connected to the composite 3D cam 20 and which further drives the rocker 64*a* or 64*b*. The rockers rotate about fixed axes 62 and the contact of each rocker with its 2D drive cam 40*a* or 40*b* is made with a roller 63. At its other end, each rocker contacts the suction or discharge valve 65*a* or 65*b*. The valves 65*a* or 65*b* successively open and close the openings of the combustion chamber 70 under the influence of the pressure coming from the rocker 64*a* or 64*b* or the springs 67.

The created cam machine can be part of a cam hybrid unit. In this case, one of the following three cycles is realized in its cylinder 26 or in one of its cylinders 26, namely: an internal combustion engine, a hydraulic or a pneumatic machine. In its opposite cylinder 26, if the opposite piston 25 is not replaced by a balancing element 60, an identical or different cycle from the cycle in the first cylinder is realized, where the unit operates in one of the following three modes—as a source, as a consumer or simultaneously as a source and a consumer of electrical, mechanical, hydraulic, pneumatic, or any possible combination of the energies listed above.

The invention claimed is:

1. A cam machine comprising:

a housing (22, 31 and 21), a first and a second cylinder (26), a first piston (25) moving in the first cylinder (26) and a second piston (25) moving in the second cylinder (26), a cylindrical tubular 3D cam (20) with a cam channel on an inner cylindrical surface which channel is made so that a line forming its cross section is a concave line having two cam profiles (15*a*, 15*b*) and a bottom (59) between them, which is laterally located relative to an axis of the cylindrical tubular 3D cam (20) and at least two asynchronously moving followers (1*a*, 1*b*) located opposite each other, each follower (1*a*, 1*b*) containing two arms (37) connected respectively to one of the first and second pistons (25), wherein the two arms (37) are spaced at an angle to each other and are provided with tubular main bearing journals (2) with main rollers (3) each having an axis and placed in bearings at a free end of the respective arms (37) and each follower (1*a*, 1*b*) further comprises cylindrical plungers (6) located in the tubular main bearings journals (2), which cylindrical plungers (6) comprise additional bearing journals (4) bearing additional rollers (5), performing both rectilinear and rotational movement in a direction and around axes of the respective main rollers (3) so that each main roller and additional roller (3 and 5) is in contact with its respective profile (15*a* or 15*b*) of the cam channel, characterized in that the tubular main bearing journals (2) have threaded holes (13) in which screw regulators (7) are mounted, contacting indirectly or directly with the cylindrical plungers (6), where the indirect contact between the cylindrical plungers (6) and adjacent screw regulators (7) is made through elastic and bearing elements (8) and (10), and the direct contact is realized by pins (11), each of which is part of the corresponding adjacent screw regulator (7), where maximum clearances (57) formed by the indirect contacts between the pins (11) and the plungers (6) are at least equal to strokes of rectilinear motions of the plungers (6) at complete rotation of the cylindrical tubular 3D cam (20), and connections between each plunger (6) and the elements located in its respective bearing journal (2) are such that the plungers (6) are freely removable from the adjacent bearing journals (2) when the cam machine is disassembled.

2. The cam machine according to claim 1, characterized in that a functional insert (56*b*) is mounted in each plunger (6) in contact with the pin (11) while making direct contact between the respective screw regulator (7) and the plunger (6), wherein a thickness of a functional insert (56*b*) is adjustable by a thickness of a respective test insert which is monolithic or composed of several elements (9*a*, 9*b* and 9*a*), and at least one element (9*b*) of the test insert is easily deformable, as the reference thickness of the test insert (9*a*, 9*b* and 9*a*) is obtained by squeezing it under a working influence of the cam machine.

3. The cam machine according to either of claim 1 or 2, characterized in that each screw regulator (7) consists of a tubular cylindrical body (46), on an outer and an inner cylindrical surfaces of which an external and an internal thread are cut, respectively, an adjustable pin (47) and a fixing element (48) are screwed in the internal thread, and the clearance between each adjustable pin (47) and the adjacent plunger (6) of the functional insert (56*b*) being at least equal to an axial stroke of the plunger (6) at one complete rotation of the cylindrical tubular 3D cam (20).

4. The cam machine according to claim 1, characterized in that the cylindrical tubular 3D cam (20) is composite and comprises two cam bushings (16*a*, 16*b*), each having a corrugated cam profile (15*a* and 15*b*) on one side, and cam bushings (16*a* and 16*b*) are arranged at a distance from each other with their corrugated ends facing each other presenting convex parts of the cam profile of one of the bushings (16*a*, 16*b*) opposite to recesses of the cam profile of the other bushing (16*a*, 16*b*) comprising at least two guide columns (27) for reciprocating linear motion of each followers (1*a* and 1*b*), which columns (27) are parallel and equidistant from the axis of the cylindrical tubular 3D cam (20).

5. The cam machine according to claim 1, characterized in that the cam channel is made so that an upper and a lower dead centres (49, 50) a distance between the cam profiles (15*a*, 15*b*) of the channel of the cylindrical tubular 3D cam (20) in the cross section is the largest, and the distance in the cross section (55) between the cam profiles (15*a*, 15*b*) of the channel of the 3D composite cam (20) between any two adjacent dead centres (49, 50) is the smallest, so that the movement of the additional bearing rollers (5) along the axes of the main bearing rollers (3) is minimized.

6. The cam machine according to claim 1, characterized in that the cam channel is designed in such a way that narrow grooves (51) are formed along rolling lines of the additional bearing rollers (5), having the greatest depth in the upper and the lower dead centres (49, 50) and their depths between any two adjacent dead centres (49, 50) are minimal, so that the movement of the additional bearing rollers (5) along the axes of the main bearing rollers (3) is minimized.

7. The cam machine according to claim 4, characterized in that each of the two cam bushings (16*a* and 16*b*) of the cylindrical tubular 3D cam (20) is fixedly and coaxially connected to a tubular element (19) which is located between them.

8. The cam machine according to claim 4, characterized in that the connection and orientation between the two cam bushings (16*a* and 16*b*) of the cylindrical tubular 3D composite cam (20) is made by a tubular element (41) which is a rotor of an electric machine and transmission of torque between the cam bushings (16*a* and 16*b*) is realized by means of teeth (43) and sockets (42), which are located on contact fronts of the cam bushings (16*a* and 16*b*), and a stator (68) of the electric machine is fixedly connected to the housing elements (31) of the cam machine.

9. The cam machine according to claim 4, wherein a connection and orientation between the two cam bushings (16*a* and 16*b*) of the cylindrical tubular 3D cam (20) is made by two flanges (36*a* and 36*b*), one flange on each of the bushings (16*a*) and (16*b*), which flanges (36*a* and 36*b*) are located around the sides of the corrugated cam profiles (15*a*) and (15*b*), the connection between the flanges (36*a*) and (36*b*) being fixed and secured by orienting fasteners.

10. The cam machine according to claim 9 characterized in that a gear ring (45) is made on a periphery of the flanges (36*a*) and (36*b*) for transmitting mechanical energy to an external working machine or for receiving energy from an external source of mechanical energy.

11. The cam machine according to claim 4, the wherein a connection and orientation between the two cam bushings (16*a* and 16*b*) of the 3D composite cam (20) is made by at least two lugs (39*a* or 39*b*) located around the sides of each of the bushings (16*a* and 16*b*) having corrugated cam profiles (15*a* and 15*b*) and connected together, wherein the connection between the lugs (39*b*) and (39*a*) of the cam bushings is fixed and is provided by means of orienting fasteners.

12. The cam machine according to claim 4 further comprising a two-cylinder compressor or hydraulic pump characterized in that the two-cylinder compressor or hydraulic pump comprise at least one cylinder head (61), hermetically dosing the cylinder (26) or one of the cylinders (26), performing a working cycle in it, wherein a fluid exchange accompanying filling and emptying processes of the cylinder (26) or the cylinders (26) is effected by a means (71) and (72) for opening and closing the compressor chamber (73).

13. The cam machine according to claim 12, characterized in that it has at least one cylinder head (61), hermetically closing the cylinder (26) or one of the cylinders (26), performing an operating cycle in it, wherein the fluid exchange accompanying the operating cycles in the cylinder (26) or cylinders (26) is realized by at least one kinematic circuit consisting of a 2D cam (40*a* or 40*b*) which is fixedly connected to a nearest adjacent side of the 3D composite cam (20), and rocker (64*a* or 64*b*), which can rotate around axis (62) under the influence of the 2D cam (40*a* or 40*b*), at least one suction or discharge valve (65*a* or 65*b*) performing reciprocating motion under the influence of the rocker (64*a* or 64*b*) and at least one return spring (67) holding the suction or discharge valve (65*a* or 65*b*) in a closed position when not activated by the rocker (64*a* or 64*b*).

14. A cam machine comprising:

a housing (22, 31 and 21), a cylinder (26), a piston (25) moving in the cylinder (26), a cylindrical tubular 3D cam (20) with a cam channel on an inner cylindrical surface which channel is made so that a line forming its cross section is a concave line having two cam profiles (15*a*, 15*b*) and a bottom (59) between them, which is laterally located relative to an axis of the cylindrical tubular 3D cam (20) and an asynchronously moving followers (1*a*, 1*b*) located opposite each other, each follower (1*a*, 1*b*) having two arms (37) connected respectively to one of the piston (25) and a balancing element (60), wherein the two arms (37) are spaced at an angle to each other and are provided with tubular main bearing journals (2) with main rollers (3) each having an axis placed in bearings at a free end of the respective arms (37) and each follower (1*a*, 1*b*) further comprises cylindrical plungers (6) located in the tubular main bearings journals (2), which cylindrical plungers (6) comprise additional bearing journals (4) bearing additional rollers (5), performing both rectilinear and rotational movement in a direction and around axes of the respective main rollers (3) so that each main roller and additional roller (3 and 5) is in contact with its respective profile (15*a* or 15*b*) of the cam channel, characterized in that the tubular main bearing journals (2) have threaded holes (13) in which screw regulators (7) are mounted, contacting indirectly or directly with the cylindrical plungers (6), where the indirect contact between the cylindrical plungers (6) and the adjacent screw regulators (7) is made through elastic and bearing elements (8) and (10), and the direct contact is realized by pins (11), each of which is part of the corresponding adjacent screw regulator (7), where maximum clearances (57) formed by the indirect contacts between the pins (11) and the plungers (6) are at least equal to strokes of rectilinear motions of the plungers (6) at complete rotation of the cylindrical tubular 3D cam (20), and connections between each plunger (6) and the elements located in its bearing journal (2) are such that the plungers (6) are freely removable from the bearing journals (2) when the cam machine is disassembled.

15. The cam machine according to claim 14, characterized in that a functional insert (56*b*) is mounted in each plunger (6) in contact with the pin (11) while making direct contact between the respective screw regulator (7) and the plunger (6), wherein a thickness of a functional insert (56*b*) is adjustable by a thickness of a respective test insert which is monolithic or composed of several elements (9*a*, 9*b* and 9*a*), and at least one element (9*b*) of the test insert is easily deformable, as the reference thickness of the test insert (9*a*, 9*b* and 9*a*) is obtained by squeezing it under a working influence of the cam machine.

16. The cam machine according to claim 14, characterized in that each screw regulator (7) consists of a tubular cylindrical body (46), on an outer and an inner cylindrical surfaces of which an external and an internal thread are cut, respectively, an adjustable pin (47) and a fixing element (48) are screwed in the internal thread, and the clearance between each adjustable pin (47) and the adjacent plunger (6) of the functional insert (56*b*) being at least equal to an axial stroke of the plunger (6) at one complete rotation of the cylindrical tubular 3D cam (20).

17. The cam machine according to claim 15, characterized in that each screw regulator (7) consists of a tubular cylindrical body (46), on an outer and an inner cylindrical surfaces of which an external and an internal thread are cut, respectively, an adjustable pin (47) and a fixing element (48) are screwed in the internal thread, and the clearance between each adjustable pin (47) and the adjacent plunger (6) of the functional insert (56*b*) being at least equal to an axial stroke of the plunger (6) at one complete rotation of the cylindrical tubular 3D cam (20).

18. The cam machine according to claim 14, characterized in that the cylindrical tubular 3D cam (20) is composite and comprises two cam bushings (16*a*, 16*b*), each having a corrugated cam profile (15*a* and 15*b*) on one side, and cam bushings (16*a* and 16*b*) are arranged at a distance from each other with their corrugated ends facing each other convex parts of the cam profile of one of the bushings (16*a*, 16*b*) opposite to recesses of the cam profile of the other bushing (16*a*, 16*b*) comprising at least two guide columns (27) for reciprocating linear motion of each followers (1*a* and 1*b*), which columns (27) are parallel and equidistant from the axis of the cylindrical tubular 3D cam (20).

19. The cam machine according to claim 14, characterized in that the cam channel is made so that an upper and a lower dead centres (49, 50) a distance between the cam profiles (15*a*, 15*b*) of the channel of the cylindrical tubular 3D cam (20) in the cross section is the largest, and the distance in the cross section (55) between the cam profiles (15*a*, 15*b*) of the channel of the 3D composite cam (20) between any two adjacent dead centres (49, 50) is the smallest, so that the movement of the additional bearing rollers (5) along the axes of the main bearing rollers (3) is minimized.

20. The cam machine according to claim 14, characterized in that the cam channel is designed in such a way that narrow grooves (51) are formed along rolling lines of the additional bearing rollers (5), having the greatest depth in the upper and the lower dead centres (49, 50) and their depths between any two adjacent dead centres (49, 50) are minimal, so that the movement of the additional bearing rollers (5) along the axes of the main bearing rollers (3) is minimized.

21. The cam machine according to claim 18, characterized in that each of the two cam bushings (16*a* and 16*b*) of the cylindrical tubular 3D cam (20) is fixedly and coaxially connected to a tubular element (19) which is located between them.

22. The cam machine according to claim 18, characterized in that the connection and orientation between the two cam bushings (16*a* and 16*b*) of the cylindrical tubular 3D composite cam (20) is made by a tubular element (41) which is a rotor of an electric machine and transmission of torque between the cam bushings (16*a* and 16*b*) is realized by means of teeth (43) and sockets (42), which are located on contact fronts of the cam bushings (16*a* and 16*b*), and a stator (68) of the electric machine is fixedly connected to the housing elements (31) of the cam machine.

23. The cam machine according to claim 18, wherein a connection and orientation between the two cam bushings (16*a* and 16*b*) of the cylindrical tubular 3D cam (20) is made by two flanges (36*a* and 36*b*), one flange on each of the bushings (16*a*) and (16*b*), which flanges (36*a* and 36*b*) are located around the sides of the corrugated cam profiles (15*a*) and (15*b*), the connection between the flanges (36*a*) and (36*b*) being fixed and secured by orienting fasteners.

24. The cam machine according to claim 23 characterized in that a gear ring (45) is made on a periphery of the flanges (36*a*) and (36*b*) for transmitting mechanical energy to an external working machine or for receiving energy from an external source of mechanical energy.

25. The cam machine according to claim 18, wherein a connection and orientation between the two cam bushings (16*a* and 16*b*) of the 3D composite cam (20) is made by at least two lugs (39*a* or 39*b*) located around the sides of each of the bushings (16*a* and 16*b*) having corrugated cam profiles (15*a* and 15*b*) and connected together, wherein the connection between the lugs (39*b*) and (39*a*) of the cam bushings is fixed and is provided by means of orienting fasteners.

26. The cam machine according to claim 18 further comprising a two cylinder compressor or hydraulic pump characterized in that the two-cylinder compressor or hydraulic pump comprise at least one cylinder head (61), hermetically dosing the cylinder (26) or one of the cylinders (26), performing a working cycle in it, wherein a fluid exchange accompanying filling and emptying processes of the cylinder (26) or the cylinders (26) is effected by a means (71) and (72) for opening and closing the compressor chamber (73).

27. The cam machine according to claim 26, characterized in that it has at least one cylinder head (61), hermetically closing the cylinder (26) or one of the cylinders (26), performing an operating cycle in it, wherein the fluid exchange accompanying the operating cycles in the cylinder (26) or cylinders (26) is realized by at least one kinematic circuit consisting of a 2D cam (40*a* or 40*b*) which is fixedly connected to a nearest adjacent side of the 3D composite cam (20), and rocker (64*a* or 64*b*), which can rotate around axis (62) under the influence of the 2D cam (40*a* or 40*b*), at least one suction or discharge valve (65*a* or 65*b*) performing reciprocating motion under the influence of the rocker (64*a* or 64*b*) and at least one return spring (67) holding the suction or discharge valve (65*a* or 65*b*) in a closed position when not activated by the rocker (64*a* or 64*b*).

* * * * *